United States Patent [19]

Conger et al.

[11] 3,985,077

[45] Oct. 12, 1976

[54] OGIVAL LENS WARHEAD

[75] Inventors: Robert L. Conger, Newport Beach; Frederic L. Menz, China Lake; Charles A. Roberts, Jr., Huntington Beach, all of Calif.

[73] Assignee: The United States of America as represented by the Secretary of the Navy, Washington, D.C.

[22] Filed: Sept. 15, 1972

[21] Appl. No.: 290,419

[52] U.S. Cl. ..... 102/56 R; 102/DIG. 2

[51] Int. Cl.[2] ..... F42B 1/00

[58] Field of Search ..... 102/24, 56, 67, 68, 102/DIG. 2

[56] References Cited

UNITED STATES PATENTS 3,280,743 10/1966 Reuther ..... 102/24 HC 3,703,865 11/1972 Gilbertson et al. ..... 102/56

*Primary Examiner*—Verlin R. Pendegrass

*Attorney, Agent, or Firm*—Richard S. Sciascia; Joseph M. St. Amand

[57] ABSTRACT

An ogival explosive warhead lens, nearly hemispherical in shape, constructed in the form of four coaxial spheroidal shells containing different explosives which when initiated at a point on the curved surface near the flat base, will result in detonation waves converging to a line on the opposite curved surface lying in a plane which passes through the axis of symmetry.

8 Claims, 3 Drawing Figures

OGIVAL LENS WARHEAD

BACKGROUND OF THE INVENTION

This invention relates to aimable blast warheads and particularly concerns a novel ogival explosive lens warhead for providing a directed side spray at a target.

The explosive Fisheye lens warheads in the past have been either spherical or cylindrical. The cylindrical shape conforms better to the space available in most missiles than does the spherically shaped warhead. However, it now appears that for some missiles a warhead having an ogival shape would be preferable to either of these. The example discussed herein applies to a missile that has an ogive-shaped warhead which is almost hemispherical in shape, but the same principles apply to any warhead of ogival shape.

SUMMARY OF THE INVENTION

The explosive ogival lens warhead is constructed in the form of four coaxial spheroidal shells containing different explosives. The outer shell is almost a hemisphere and each of the inner shells are in the form of prolate spheroids having their axes of symmetry coaxial with the axis of symmetry of the hemisphere. The ogival lens warhead can be aimed, without physically turning the warhead itself, by initiating the warhead at any point about the curved surface near the flat base resulting in detonation waves propagating through the warhead and converging to a line on the opposite curved surface lying on a plane which passes through the axis of symmetry. The blast is thus focused in the direction of aim.

Other objects, advantages and novel features of the invention will become apparent from the following detailed description of the invention when considered in conjunction with the accompanying drawings wherein:

DESCRIPTION OF THE PREFERRED EMBODIMENT

Figure 1:
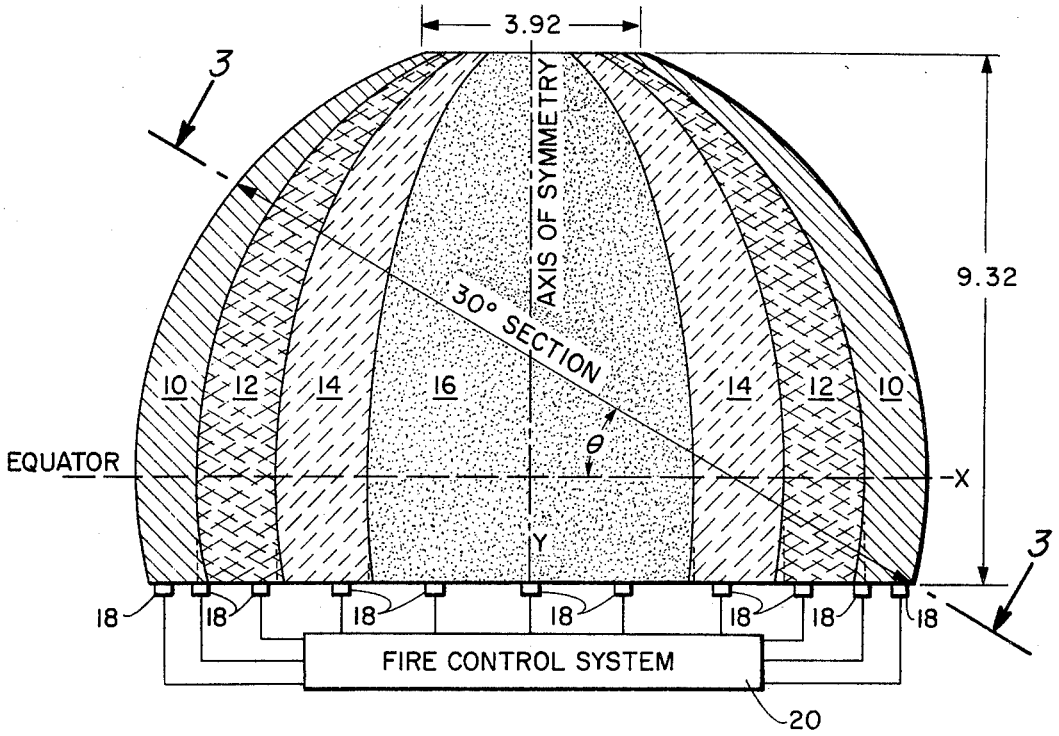
FIG. 1 is a cross-sectional view of an embodiment of the invention showing coaxial shells of different explosives.

The explosive ogival lens warhead of this invention is constructed from concentric shells of different explosives. All sections through the lens parallel to the flat surface have the same shape. In other words, if the shells at the ogive base have radii that are 0.4, 0.65, and 0.85 of the outer radius at the base, for example, then the radii of the shells on any section through the lens parallel to the base will have the same ratios. Simple calculations show that if the outer shell is a hemisphere each of the inner shells will be a prolate spheroid. Each of the spheroids 10, 12, 14 and 16 have an axis of symmetry coaxial with the axis of symmetry of the hemisphere. The hemispherical design is transformed to the ogival design by having the centers of the elliptical sections offset from the axis of symmetry by an amount proportional to the length of the semi-minor axis. The semi-major axes of all the ellipses are the same and are equal to the radius of the hemisphere. An embodiment of the warhead of the invention is truncated at the top, as shown in FIG. 1.

Typical explosives that can be used for the ogival warhead are high energy PBX-9404 pressed explosive for the outer hemispherical shell 10, followed by H-6 for shell 12 and Minol II for shell 14, with a low energy Baranol mix for the core 16 explosive. Other suitable explosives can also be used, as well as a different number of shells and any suitable fragmentation jacket can be used about the warhead. Also, the explosives may be of different densities to vary the detonation velocity and pressure in the various explosive shells.

An analytical study was made to determine what effect single-point initiation would have on the detonation front within the charge. Huygens principle was employed to determine the wave shaping as a function of time. This principle is a geometrical method for finding, from the known shape of a wave front and the velocity of the different explosives at some instant, what the shape of the wave front will be at some later instant. The principle states that every point on an advancing wave front acts as a source that sends out new waves. The combined effect is propagation of the wave as a whole.

Figure 2:
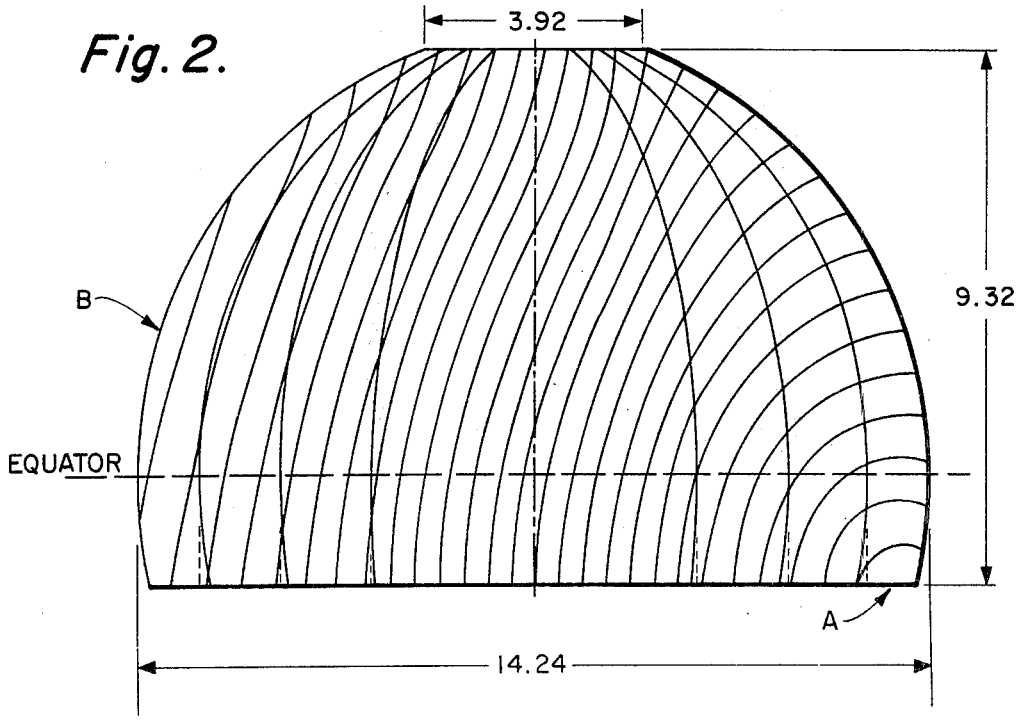
FIG. 2 is a Huygens construction diagram for an ogival warhead as in Fig. 1 showing detonation wave travel.

The Huygens construction diagram of FIG. 2 shows that if an ogival explosive lens, as in FIG. 1, is detonated at a point on the curved surface near the base of the lens point A for example, the detonation wave will converge on the opposite side of the lens to a curve B which is almost parallel to the opposite face of the lens and which lies in a plane C that contains the axis of symmetry. Dimensions shown by way of example in FIGS. 1 and 2 are in inches.

Detonation waves progress through the warhead along planes that are not parallel to the base of the lens. Along these planes the configuration is not concentric circles, but off center ellipses.

FIG. 1 shows such a plane by a 30° section line running from the lower right hand corner to the opposite side. The configuration of such a plane is represented by the intersection of a plane with a set of coaxial prolate spheroids. The plane makes an angle $\theta$ with the $x$ axis. The spheroids have equations of the form $$a(x^2 + y^2) + z^2 = 1 \tag{1}$$

where $$1 \leqslant a \leqslant \infty$$

and the plane has the equation $$z = bx + c \tag{2}$$

where $0 < b < \infty$ $0 < c < 1$

Solving Eq. 1 and 2 simultaneously gives the equation for the intersection of the plane with the spheroids:

$$(a + b^2)x^2 + 2bcx + ay^2 = 1 - c^2 \tag{3}$$

Let $x'$ and $y'$ be the coordinates in the tilted plane. Then $$x' = x/\cos\theta \qquad y' = y \tag{4}$$

where $$\cos\theta = 1/\sqrt{1+b^2} \tag{5}$$

In the tilted plane the equation for the intersection of the plane with the spheroids becomes $$\frac{(a+b^2)\,x'^2}{1+b^2} + \frac{2bcx'}{\sqrt{1+b^2}} + ay'^2 = 1 - x^2 \tag{6}$$

This is the equation of an ellipse with eccentricity $\epsilon$ given by $$\epsilon = b\sqrt{\frac{a-1}{a(1+b^2)}} \tag{7}$$

and with the center of the ellipse displaced from the origin of the tilted coordinate system by an amount $$d = \frac{bc\sqrt{1+b^2}}{1+b^2} \tag{8}$$

Let the angle of the plane $\theta$ be 30°; then $b = 1/\sqrt{3}$. Let the plane intersect the $x$ axis at $x = -1$ (at the equator of the outermost spherical shell); then $c = 1/\sqrt{3}$ also. The parameter a will be given the values 1.0, 1.39, 2.37, and 6.25, corresponding to the semi-minor axis values of the spheroidal shells (1.0, 0.85, 0.65, and 0.40) times the radius of the outer spherical shell. With these values for the parameter a, the eccentricity $\epsilon$ and the center displacement d have the values shown in Table 1.

In the ogival lens none of the spheroidal shells have a semiminor axis much less than half the outer radius. Therefore, all the ellipses are approximately circles.

TABLE 1.

Eccentricity and Center Displacement of Ellipses Produced by Intersection of 30-deg Plane with Coaxial Spheroidal Shells

| Geometric factor | Value | | | |
|---|---|---|---|---|
| Parameter a | 1 | 1.39 | 2.37 | 6.25 |
| Semi-minor axis | 1 | 0.85 | 0.65 | 0.40 |
| Eccentricity, $\epsilon$ | 0 | 0.264 | 0.381 | 0.452 |
| Center Displacement, d | 0.289 | 0.223 | 0.142 | 0.0585 |

The average radius of the ellipses is given by the equation $$r^2 = \frac{1 - c^2 + b^2c^2/(a+b^2)}{[(a+b^2)/(1+b^2) + a]/2} \tag{9}$$

which, for an intersecting plane angle of 30°, becomes $$r^2 = \frac{8(2a+1)}{(3a+1)(7a+1)} \tag{10}$$

Table 2 shows the average values of the radii of the ellipses for the values of the parameter a (shown in Table 1) as calculated from Eq. 10. For the case where $a = 1.0$, the ellipse is actually a circle and $r_{av}$ is the actual radius.

TABLE 2.

Average Radii of Ellipses as a Function of Parameter a

| Geometric factor | Value | | | |
|---|---|---|---|---|
| Parameter a | 1 | 1.39 | 2.37 | 6.25 |
| $r_{av}$ | 0.866 | 0.736 | 0.567 | 0.350 |

Figure 3:
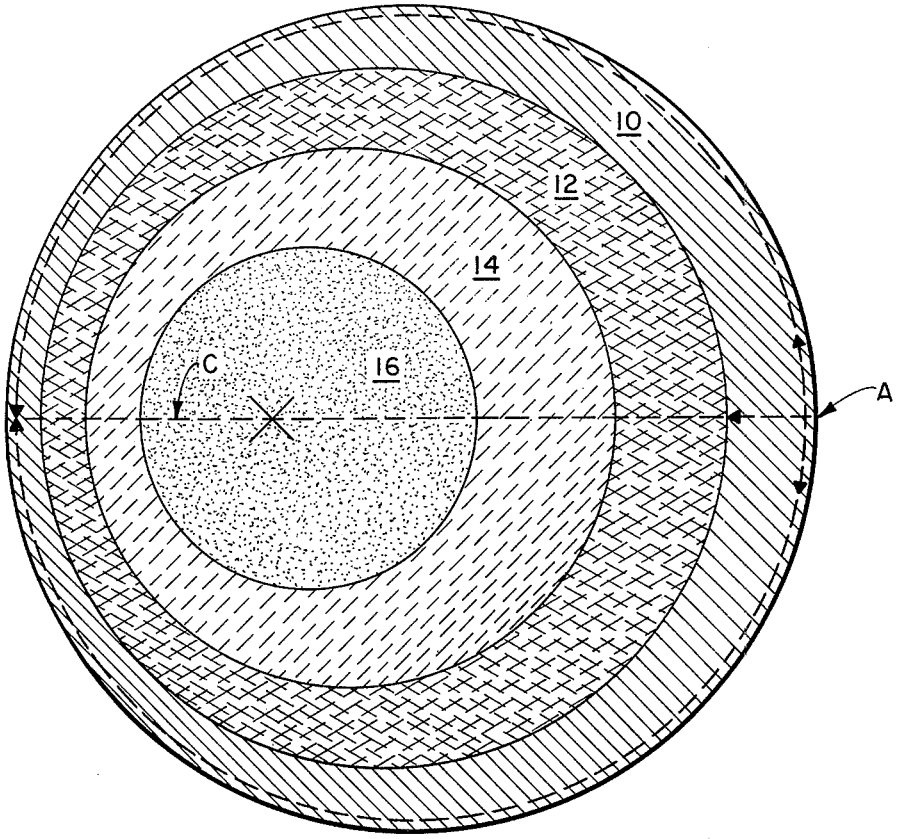
FIG. 3 shows the approximate pattern of the 30° plane intersecting a coaxial set of spheroidal shells similar to those shown in Fig. 1.

FIG. 3 shows a set of circles with the radii given by Table 2 and with the center displacement given by Table 1.

Three detonation paths (the dashed lines in FIG. 3) must take the same time in propagating through the explosive lens in which the cylinders are offset, as shown in FIG. 3. A straight path through the center passes through the same amount of each explosive and the detonation path around the outer shell goes through only one explosive, the detonation paths all coming to a focus.

Aiming of a warhead is difficult because of the inability to determine, until a few milliseconds before a warhead is detonated, on which side of a target the missile and warhead will pass. Thus, the warhead must be aimed at the target and detonated in a period of a few milliseconds or less. In such a short time, it is almost impossible to aim the warhead by changing its attitude, because the inertia of the warhead makes it impossible to physically rotate it into the proper position sufficiently fast to hit the target.

The present type warhead can be aimed and fired within the time frame allowed without any physical rotation of the warhead required.

A plurality of detonators 18, bridge-wire type or plane wave generators, etc., are mounted circumferentially about the base of the near hemispherical warhead. Any one of the detonators can be selectively fired on command by a fire control system 20 which determines the direction of aim, and when and which detonator 18 to fire. The type and/or density of explosive for each of the coaxial spheroidal shells is selected for its detonation velocity so that upon detonation of the warhead the detonation waves will progress through the warhead and converge to a line on the opposite curved surface lying on a plane which passes through the axis of symmetry. The warhead fragments are thus fired in an arc in the direction of aim. The four explosives given by way of example perform in this manner.

With detonators spaced about the circumference of the base of the ogive warhead, the warhead can be simultaneously aimed and fired in any direction by the fire control 20. When a detonator opposite the side of the direction of aim is fired, detonation waves progressing through the warhead will detonate all the explosives in such a way, as previously described, as to focus the detonation waves in the direction of aim. A greater efficiency is thus obtained with most of the energy directed in an arc as a spray blast toward the target.

The composition, detonation velocity and density of the explosives given above by way of example, for the various explosive shells are given as shown in TABLE III.

TABLE III

| EXPLOSIVE DESIGNATION | COMPOSITION | DETONATION VELOCITY (M/SEC) | DENSITY (gm/cc) |
|---|---|---|---|
| PBX-9409 | 94 HMX<br>3 Nitrocellulose<br>3 CEF | 8840 | 1.85 |
| H-6 | 45 RDX<br>30 TNT<br>20 Alum.<br>5 Wax | 7200 | 1.7 |
| MINOL II | 40 Ammonium Nitrate<br>40 TNT<br>20 Alum. | 5820 | 1.64 |
| Baronal | 50 Barium Nitrate<br>35 TNT<br>15 Alum | 5400 | 2.3 |

What is claimed is:

1. An explosive missile warhead for producing a spray blast toward a target, operable to be aimed without physical rotation of the warhead and fired in any given direction about the axis of symmetry, comprising:
   a. an inhomogeneous ogive shaped explosive lens having a circular base and ogive sides;
   b. said explosive lens consisting of a plurality of spheroidal explosive shells about a spheroidal explosive core all having their axis of symmetry coaxial;
   c. the sides of the inner said explosive shells being in the form of prolate spheroids;
   d. a plurality of detonators mounted and spaced about the circumference of the circular base of said ogive shaped explosive lens for initiating said explosive lens;
   e. fire control means for selecting and firing any of said detonators upon command;
   f. said ogive shaped explosive lens operable to be aimed by selectively firing a detonator on the opposite side of the warhead from the desired direction of aim;
   g. said explosive lens warhead upon detonation of any one of said detonators operable to cause detonation waves to progress from the point of detonation through the entire warhead detonating all the explosive therein such that the detonation waves are focused and converge on a line on the opposite curved surface lying in a plane which passes through the axis of symmetry of the ogive shaped explosive, thus providing a spray blast of warhead fragments in an arc outward from said surface along said line in the direction of aim.

2. A warhead as in claim 1 wherein said outside surface is an ogive mearly hemispherical in shape.

3. A warhead as in claim 1 wherein the explosives of adjacent explosive shells and core are each of different density.

4. A warhead as in claim 1 wherein said explosive shells and core are each of different explosive composition.

5. A warhead as in claim 1 wherein four explosives are used, the outer shell composition by weight consisting of 94 parts HMX, 3 parts nitrocellulose and 3 parts CEF; the second shell composition by weight consisting of 45 parts RDX, 30 parts TNT, 20 parts aluminum and 5 parts wax; the third shell composition by weight consisting of 40 parts ammonium nitrate, 40 parts TNT and 20 parts aluminum; and a composition by weight consisting of 50 parts barium nitrate, 35 parts TNT and 15 parts aluminum for the core.

6. A warhead as in claim 1 wherein said ogive shaped explosive lens has an outer ogive shaped warhead fragmentation casing.

7. A warhead as in claim 1 wherein the detonation waves following a path through the center of said warhead pass through the same amount of each explosive and detonation waves following a path around the outer shell pass through only one explosive, the detonation waves propagating through the explosive lens along said paths in the same amount of time.

8. A warhead as in claim 1 operable to be aimed at a target and detonated in a maximum period of time of a few milliseconds.

* * * * *